US006073276A

United States Patent [19]

Rasmussen

[11] Patent Number: 6,073,276

[45] Date of Patent: Jun. 13, 2000

[54] ADJUSTABLE WALL-MOUNTED SHAMPOO BOWL

[75] Inventor: Thomas G. Rasmussen, Rockford, Ill.

[73] Assignee: Belvedere USA Corporation, Belvidere, Ill.

[21] Appl. No.: 08/910,910

[22] Filed: Aug. 13, 1997

[51] Int. Cl.[7] ..... A45D 19/08

[52] U.S. Cl. ..... 4/519; 4/644

[58] Field of Search ..... 4/515–523, 643–645, 4/648, 627

[56] References Cited

U.S. PATENT DOCUMENTS

| | | | |
|---|---|---|---|
| 1,083,707 | 1/1914 | Sparenburg | 4/522 |
| 3,849,806 | 11/1974 | Strickland . | |
| 4,328,597 | 5/1982 | Bodin | 4/644 |
| 5,007,118 | 4/1991 | Ebersole | 4/516 X |
| 5,014,371 | 5/1991 | Heel . | |

FOREIGN PATENT DOCUMENTS

| | | | |
|---|---|---|---|
| 1083784 | 1/1955 | France | 4/515 |

OTHER PUBLICATIONS

Belvedere Co., Gilda Backwash, Advertizing Sheet, 2 Pages, Copyright 1996.

Belvedere Co., Lillo, Advertizing Sheet, 2 Pages, Copyright 1996.

Belvedere Co., Flexi–Bowl, Advertizing Sheet, 2 Pages, Copyright 1986.

Maletti Group, Business Class, Advertising Sheet, 1 Page.

BJ Industries, Inc., Advertizing Brochure, 7 Pages, Adjust–a–Sink System.

*Primary Examiner*—Charles E. Phillips
*Attorney, Agent, or Firm*—Abelman, Frayne & Schwab

[57] ABSTRACT

The forward portion of a shampoo bowl is formed with a neck rest for receiving and supporting the back of the neck of an individual seated in a chair located forwardly of the bowl. The shampoo bowl is wall-mounted and pivotally connected for selective tilting of the forward portion of the bowl to raise or lower the height of the neck rest so as to accommodate individuals of varying heights seated in the chair.

17 Claims, 4 Drawing Sheets

ADJUSTABLE WALL-MOUNTED SHAMPOO BOWL

BACKGROUND OF THE INVENTION

The present invention relates to sinks and shampoo bowls of the type commonly used in beauty salons and barber shops.

Shampoo bowls of this general type typically include a forward edge portion that is formed with a so-called neck rest. The neck rest is a rearwardly extending, rounded cut-out adapted to define a forwardly and upwardly facing depression adapted to receive an individual's neck.

When shampooing an individual's hair in a beauty salon or barber shop, it is common practice to seat the individual in a chair that is positioned forwardly of the shampoo bowl, and tilt the individual's head backward over the bowl. Preferably, the individual's neck is received into and generally supported by the neck rest formed in the bowl.

Numerous prior apparatus and methods have been adapted to allow persons of different heights rest his or her neck into the neck rest of the shampoo bowl. A common technique is to provide for a chair with an adjustable seat height such as Shoji, U.S. Pat. No. 3,810,673, Benting, U.S. Pat. No. 4,918,767, and Kanaya U.S. Pat. No. 5,257,851. However, these disclosures involve relatively complicated and expensive apparatus.

Alternately, chairs may be provided with pivotally connected backs to enable each person to reposition the angle of the back, and the position of the chair inwardly and outwardly from the bowl so as to adjust the length between the chair seat and the neck rest. Frequently, however, the individual will not make the necessary adjustment, but will simply "slide" up or down in the chair, thus leaving the lower back unsupported.

In some "European-style" arrangements, the shampoo bowl and chair are connected to a pedestal for positioning in a room such that the beautician or barber stands behind the bowl to wash the individual's hair. In this instance, the shampoo bowl may be pivotally mounted to the pedestal to enable positioning of the bowl to accommodate an individual's height. However, such an arrangement has met with limited acceptance in the United States because the shampoo bowl is traditionally and typically mounted to a wall, and the beautician or barber stands adjacent the bowl when washing the individual's hair.

Another prior apparatus provides for a wall-mounted sink that is adapted for selective linear positioning upwardly and downwardly. This apparatus includes foot-operated means for adjusting the height of the sink in a action similar to a hydraulic beauty or barber chair. However, this apparatus is also substantially more expensive than a simple wall-mounted shampoo bowl.

SUMMARY OF THE INVENTION

The general aim of the present invention is to provide for a new and improved wall-mounted shampoo bowl adapted to accommodate individuals of different heights.

A detailed objective is to achieve the foregoing by providing an adjustable wall-mounted shampoo bowl apparatus adapted for use with a conventional chair, the apparatus being less expensive, of simpler construction, and more easily adjusted than prior adjustable wall-mounted shampoo bowls of the same general type.

A more detailed objective is to achieve the foregoing by providing a shampoo bowl which is pivotally connected to a wall-mounted supporting structure such that the forward portion of the bowl may be tilted to a height for receiving the neck of an individual seated in the chair, the pivotal connection providing a frictional drag component sufficient to retain the bowl in the position selectively set by the operator.

These and other objectives and advantages of the invention will become more apparent from the following detailed description when taken in conjunction with the accompanying drawings.

In one embodiment of the invention, the apparatus includes a support structure that is cantilevered from a wall, and a shampoo bowl that is positioned above and supported by the frame. Frictional pivot connecting means between the frame and the shampoo bowl provide for manual tilting of the bowl by the operator while insuring that the bowl remains in the selected position while shampooing an individual's hair. Pairs of rubber bumpers positioned between the frame and the bowl, and on either side of the pivot connection provide for predetermined limits on the angular travel of the adjustable bowl.

Figure 1:
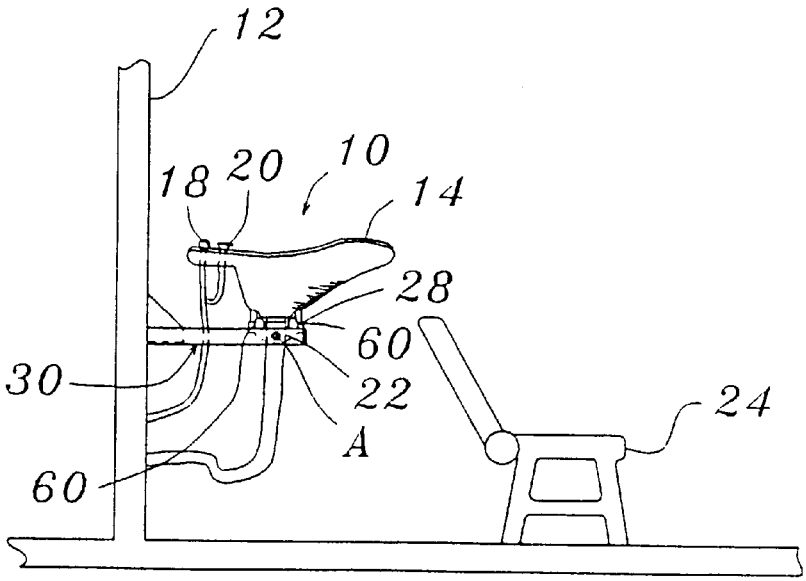
FIG. 1 is a side elevation view of a chair and an adjustable shampoo bowl apparatus in a generally horizontal position, the apparatus incorporating the unique aspects of the present invention.

While the invention is susceptible of various modifications and alternative constructions, certain illustrated embodiments have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF THE INVENTION

For purposes of illustration, the present invention is shown in the drawings in connection with a shampoo bowl 10 (FIG. 1) of the type typically used in beauty salons or barber shops. The shampoo bowl is mounted to and extends forwardly from a wall portion 12, and includes a forward edge portion 14 formed with a rearwardly extending neck-receiving cut-out or depression 16. The shampoo bowl is provided with conventional water supply valve fittings 18 and a shampoo head 20 flexibly connected to the building water supply (not shown), and with drain fittings 22 connected to the building drain system (not shown).

During a conventional hair shampooing session, an individual is seated in a chair 24 movably associated with and located forwardly of the shampoo bowl 10 with his or her head tilted backwardly over the bowl, and the beautician or barber stands to the side of the bowl for washing the individual's hair.

Figure 3:
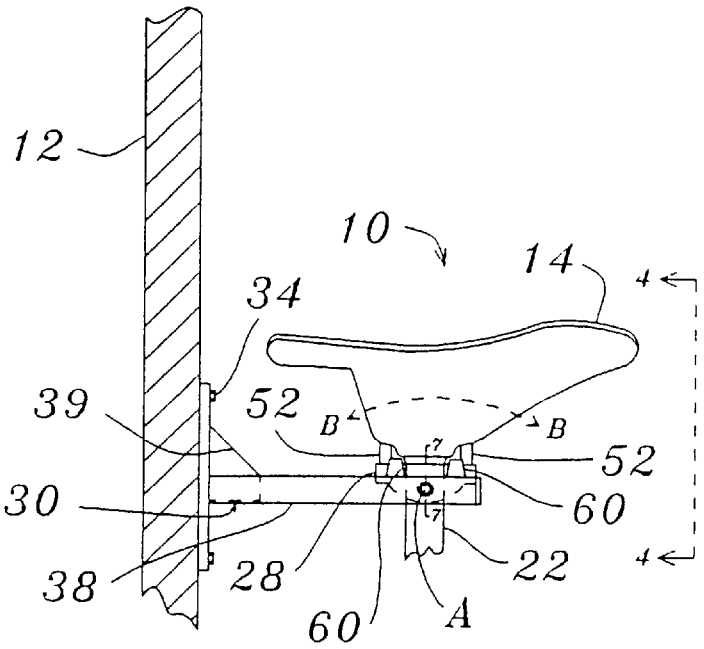
FIG. 3 is an enlarged side view of the shampoo bowl apparatus of FIG. 1.
Figure 4:
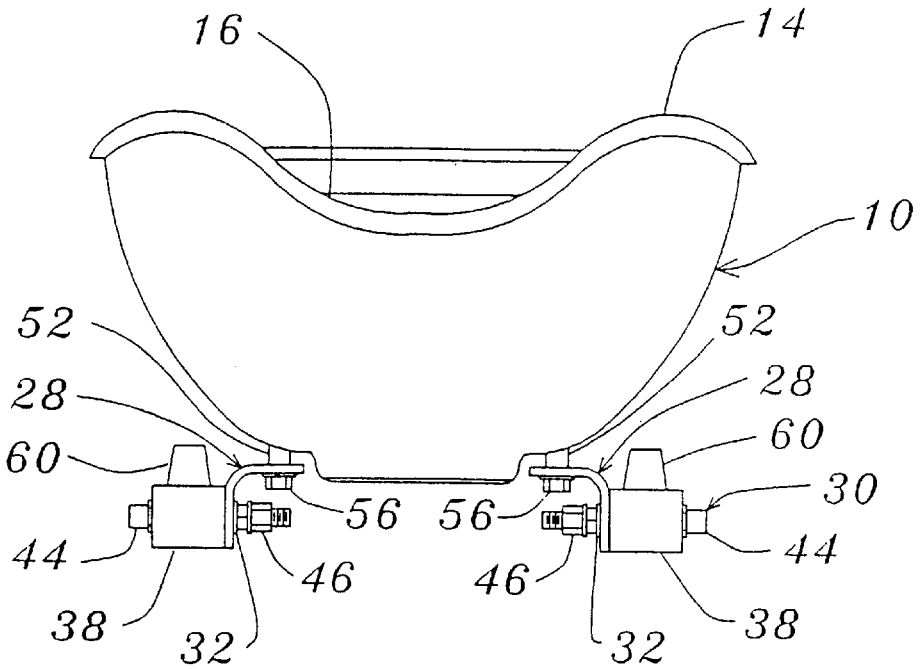
FIG. 4 is a view taken substantially along the line 4—4 of FIG. 3.

In accordance with the present invention, the shampoo bowl 10 is pivotally mounted relative to the wall 12 for selective tilting or positioning of the bowl as generally indicated with the dashed lines B—B in FIG. 3. As a result, the neck rest 16 formed in the forward portion of shampoo bowl is easily adjusted upwardly and downwardly relative to the chair 24.

More specifically, the shampoo bowl 10 rests on and is connected to brackets 28 (FIG. 3) that are pivotally connected to a supporting frame 30 at "A". In the embodiment shown, the support frame is cantilevered from the wall 12 and positioned under the bowl in supporting relationship thereof. The pivot connection (discussed further below) enables manual pivoting of the brackets 28, and thus the bowl, relative to the support frame, while clutch or friction members such as spring washers 32 are adapted to prevent the bowl from pivoting due to the weight of the bowl, thus holding the bowl in the manually selected position.

Figure 5:
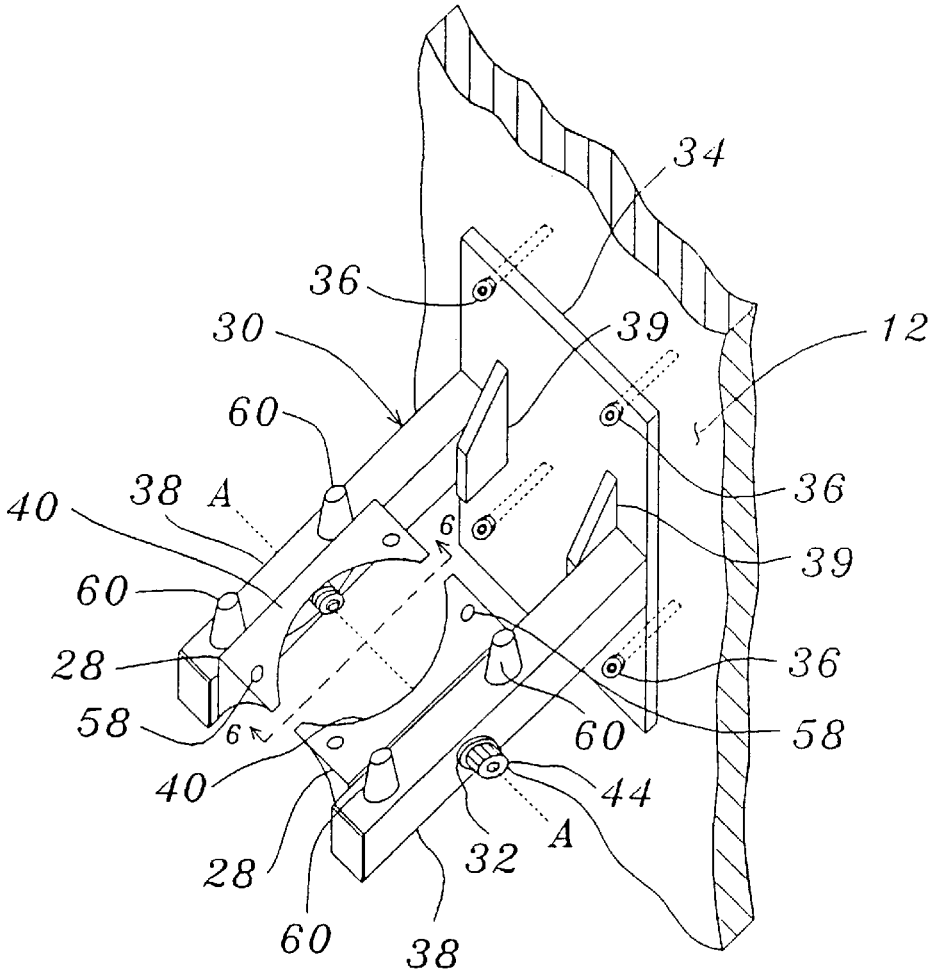
FIG. 5 is an enlarged perspective view of certain parts shown in FIGS. 1–4.
Figure 6:
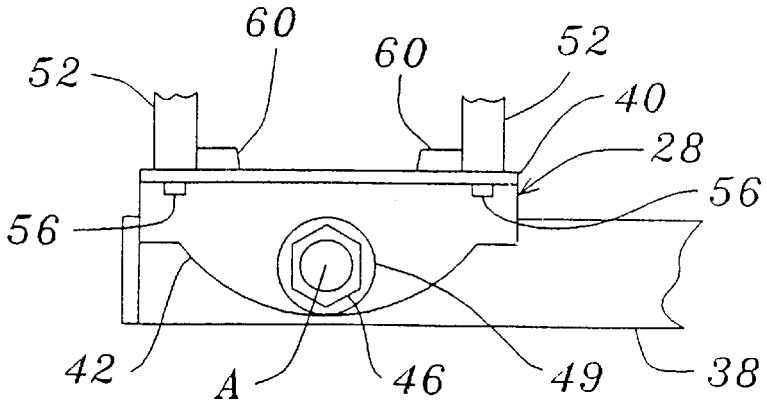
FIG. 6 is an enlarged view taken substantially along the line 6—6 of FIG. 5.

In carrying out the invention, the frame 30 (FIG. 5) includes a vertical plate 34 secured to the supporting structure of the wall portion 12 with fasteners 36 or other suitable means. Two support arms 38 are fixedly connected to the plate by fasteners, welding, or other suitable means, and extend generally horizontally and forwardly from the plate. Supports ribs 39 welded or otherwise secured between the plate and the support arms provide additional supporting structure to otherwise reduce the size of the support arms needed to carry the weight of the shampoo bowl 10.

Figure 7:
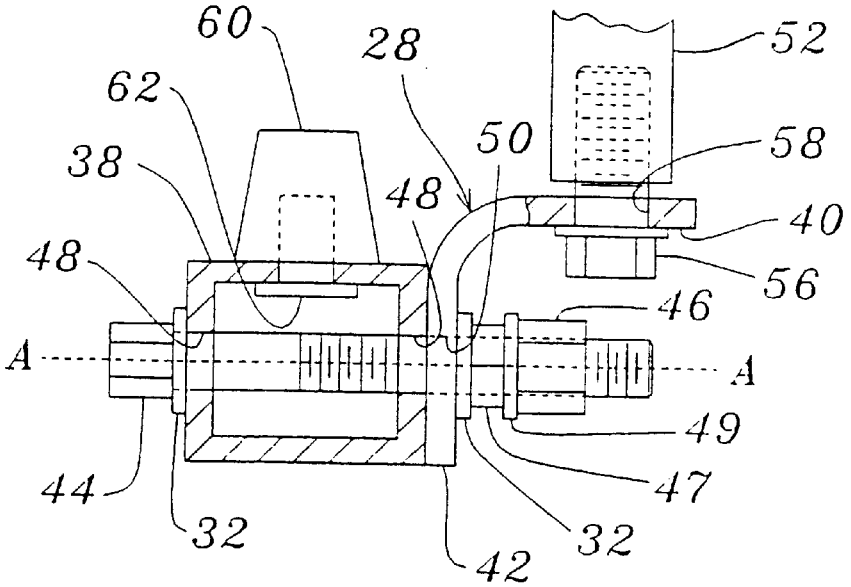
FIG. 7 an enlarged cross-sectional view taken substantially along the line 7—7 of FIG. 3.
Figure 8:
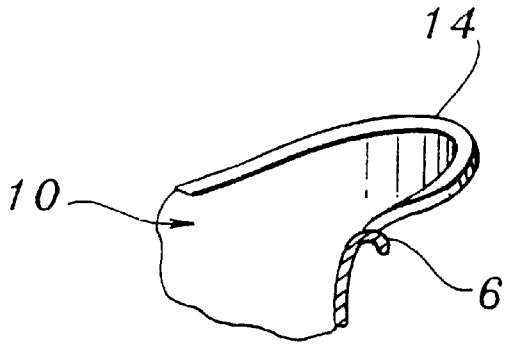
FIG. 8 is an enlarged fragmentary cross-sectional view taken substantially along the line 8—8 of FIG. 4.

The brackets 28 are formed with a generally horizontal platform section 40 and a vertically extending leg section 42 to define a generally L-shaped cross-section (see FIG. 7). The brackets are pivotally connected to the support arms 38 with threaded bolts 44 and nuts 46, 47. To this end, the bolts 44 extend through horizontally extending aligned openings 48 and 50 formed laterally through the support arms and the leg sections of the brackets, respectively.

In keeping with the invention, the shampoo bowl 10 is adapted for fixed connection to the brackets 28. In this instance, the bowl includes integrally formed feet portions 52 that extend downwardly from the base portion of the bowl. Vertically extending openings 58 corresponding to and aligned with the feet 52 are formed through the platform portions 40 of the brackets. With this arrangement, the feet of the shampoo bowl rest onto the horizontal platforms, and the bowl is secured to the brackets with fasteners 56 extending upwardly through the openings 58 in the platform and threadably received into the threaded openings 54 formed in the feet.

Advantageously, spring washers 32 such as Bellville springs (FIG. 7) are squeezed against the support arms 38 and the leg portions 42 of the brackets 28 to a predetermined preload force by tightening of the nuts 47 onto the bolts 44 to impart a frictional drag onto the pivotal movement of the brackets. In this instance, the spring washers are positioned between the bolt heads and the support arms 38, and between the jam nuts 47 and the bracket legs. The jam nuts are tightened to load the spring washers against the brackets and the support arms with a predetermined force. Lock washers 49 and nuts 46 are then secured against the jam nuts to maintain the jam nuts in the desired position for the desired spring force preload.

To maintain the shampoo bowl 10 in a manually selected position, the frictional drag from the washers 32 is greater than the pivoting torque resulting from the weight of the bowl. It is also desirable that the frictional drag be relatively easy to overcome for manual pivoting of the bowl. Thus, in a preferred embodiment, the center of gravity of the bowl is generally vertically aligned with the pivot bolts 44 so as to reduce the frictional needed to hold the weight of the bowl after it has been manually tilted to a desired position.

With the foregoing arrangement, the shampoo bowl 10 is manually pivotable about a horizontal axis designated "A" extending through the center of the bolts 44 for selectively positioning the forward portion of the bowl including the neck rest 16 such that the neck of an individual sitting in the chair 24 may be received into the neck rest portion of the bowl.

Figure 2:
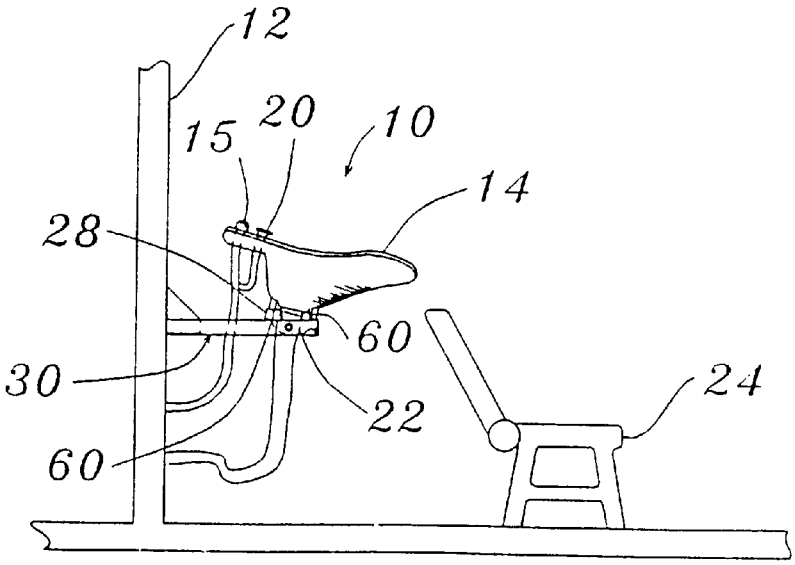
FIG. 2 is a view similar to FIG. 1 showing the shampoo bowl in a tilted position.

Advantageously, rubber bumpers 60 are adapted to restrict the forward and backward pivoting of the shampoo bowl 10. Such an arrangement limits the flexure that needs to be provided in the water supply and drain lines to the bowl, and precludes the possibility that the bowl will contact the supporting frame structure 30. To this end, the rubber bumpers are secured to the stationary support arms 38 with, for example, fasteners 62 (FIG. 7) such that the bumpers are positioned both forwardly and rearwardly of the pivot bolts 44 and extend upwardly from the support arms. The bumpers are further positioned and sized to engage the underside of the base portion of the bowl when the bowl has been pivoted forwardly such as is shown in FIG. 2 or rearwardly, to predetermined angular limits in the forward and backward direction.

Figure 9:
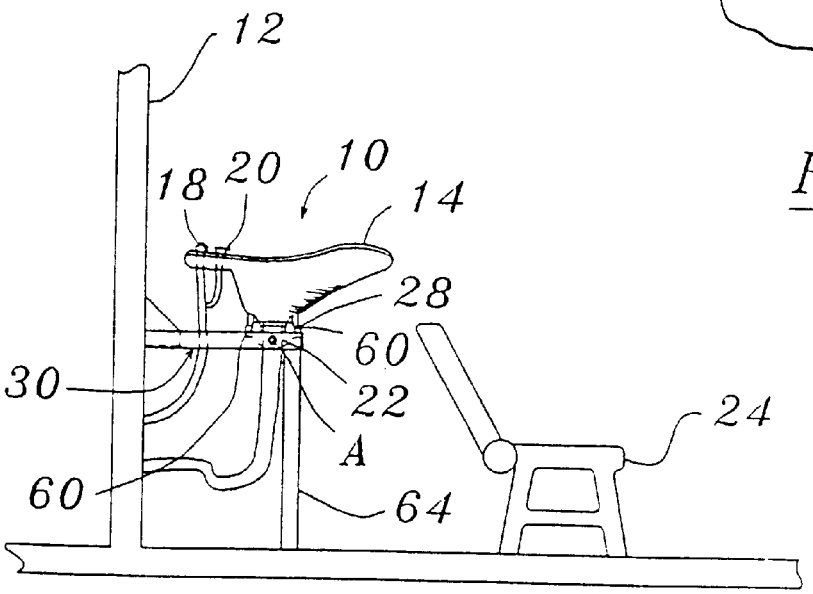
FIG. 9 is a view similar to FIG. 1 of an alternate embodiment of the invention.

In an alternate embodiment (FIG. 9), the generally horizontal support frame 30 connected to the wall 12 is further supported by legs 64 extending to the floor near the forward portion thereof. In this instance, the supporting frame and legs may optionally enclosed by a storage cabinet (not shown). This and other embodiments of the invention will be apparent to those persons skilled in the art.

From the foregoing, it is apparent that the present invention brings to the art a new and improved shampoo bowl apparatus. By virtue of the unique and relatively simple arrangement of the pivoting wall-mounted shampoo bowl 10, the forward portion of the bowl is easily adjusted for positioning of the neck rest 16 at a convenient height for receiving and supporting the neck of an individual seated in the chair 24. Accordingly, the present invention accommodates shampooing of individuals of different heights by simply adjusting the position of the bowl by the beautician or barber without the need and expense associated with a chair having an adjustable seat height.

I claim:

1. Hair shampoo apparatus for use in a room having a floor and a vertical wall portion fixed to and extending upwardly from the floor, said apparatus comprising:

shampoo bowl means;

water supply means and water drain means associated with said bowl;

a support connected to and extending generally forwardly from said wall; and means for pivotally connecting said bowl means to said support for manual tilting of said bowl about a generally horizontally extending axis between first and second positions, said connecting means including spring washer means resiliently loaded against and frictionally clamping said bowl means to said support for maintaining said bowl means in manually tilted positions intermediate said first and second positions.

2. Apparatus according to claim 1 further comprising forward and rear bumper means disposed between said bowl means and said support, and located forwardly and rearwardly of said connecting means, respectively; said forward and rear bumper means being connected to one of said bowl means and said support, and adapted for engagement therebetween as said bowl means is tilted in one direction and then in the opposite direction, respectively, for limiting the pivoting of said bowl means and establishing said first and second positions.

3. Apparatus as defined in claim 2 in which said bumper means are formed from resilient rubber.

4. Apparatus as defined in claim 1 in which said horizontal axis is located below and generally vertically aligned with the center of gravity of said bowl means, and in which said spring washer means are aligned along said axis.

5. Hair shampoo apparatus for use in a room having a floor and a vertical wall portion fixed to and extending upwardly from the floor, said apparatus comprising:

shampoo bowl means;

water supply means and water drain means associated with said bowl;

a support connected to and extending generally forwardly from said wall;

means for pivotally connecting said bowl means to said support for manual tilting of said bowl about a generally horizontally extending axis;

forward and rear bumper means disposed between said bowl means and said support, and located forwardly and rearwardly of said connecting means, respectively;

said bumper means being connected to one of said bowl means and said support, and adapted for engagement therebetween as the bowl is tilted in one direction and then in the opposite direction for limiting the pivoting of said bowl means between first and second positions; and means for maintaining said bowl means in manually tilted positions intermediate said first and second positions.

6. Apparatus according to claim 5 in which said support includes two generally horizontal spaced arms cantilevered from said wall and located generally under and on either side of said bowl means.

7. Apparatus as defined in claim 5 in which said bumper means are formed from resilient rubber.

8. Apparatus according to claim 5 in which said maintaining means including spring washer means resiliently loaded against and frictionally clamping said bowl means to said support for maintaining said bowl means in said intermediate positions.

9. Apparatus according to claim 5 in which said maintaining means includes spring washer means resiliently loading against and frictionally clamping said bowl means to said support, said spring washer means imparting sufficient frictional drag against said leg means to counteract the weight of said bowl means and maintain said bowl means in said intermediate positions.

10. Apparatus as defined in claim 9 in which said horizontal axis is generally vertically aligned with the center of gravity of the bowl, and in which said spring washer means are aligned along said axis.

11. Hair shampooing apparatus for use in a room having a floor and a vertical wall portion fixed to and extending upwardly from the floor, said apparatus comprising:

support arm means cantilevered generally forwardly from said wall portion;

bracket means having vertical leg means;

a shampoo bowl connected to said bracket means;

water supply means and water drain means associated with said bowl; and pivot pin means connecting said support arm means and said leg means to provide for manual tilting of said bowl about a generally horizontal axis between first and second positions, said pivot pin means including means for frictionally clamping said leg means to said arm means to maintain the bowl in manually tilted positions intermediate said first and second positions.

12. Apparatus according to claim 11 in which said bracket means includes generally horizontal platform means and in which said bowl includes downwardly extending feet portions connected thereto.

13. Apparatus according to claim 11 in which said support arm means includes two generally horizontal spaced arms cantilevered from said wall and located generally under and on either side of the bowl.

14. Apparatus according to claim 13 further comprising forward and rear bumper means disposed between said bowl and said support arm means, and located forwardly and rearwardly of said pivot means, respectively; said forward and rear bumper means being connected to one of said support arm means and said bowl, and adapted for engagement therebetween as the bowl is tilted in one direction and then in the opposite direction, respectively, to limit the range of tilting of the bowl between said first and second positions.

15. Apparatus as defined in claim 14 in which said bumper means are formed from resilient rubber.

16. Apparatus according to claim 11 in which said clamping means includes spring washer means resiliently loading against and frictionally clamping said leg means to said support arm means, said spring washer means imparting sufficient frictional drag against said leg means to counteract the weight of the bowl and maintain the bowl in said intermediate positions.

17. Apparatus as defined in claim 16 in which said horizontal axis is located below and generally vertically aligned with the center of gravity of the bowl, and in which said spring washers are aligned along said axis.

* * * * *